US005203117A

United States Patent [19]

Jen

[11] Patent Number: 5,203,117

[45] Date of Patent: Apr. 20, 1993

[54] BELT SANDER SANDING MECHANISM

[76] Inventor: Chih-Lung Jen, No. 19, Alley 8, Lane 548, Chungshan Rd., Shen Kang Hsiang, Taichung Hsien, Taiwan

[21] Appl. No.: 772,958

[22] Filed: Oct. 8, 1991

[51] Int. Cl.[5] ..... B24B 21/00

[52] U.S. Cl. ..... 51/135 R; 51/139; 51/140; 51/3

[58] Field of Search ..... 51/135 R, 137, 138, 51/139, 140, 328; 29/33 R, 33 A, 33 P, 33 Q, 33 S, 564, 650, DIG. 19

[56] References Cited

U.S. PATENT DOCUMENTS

| | | | |
|---|---|---|---|
| 2,187,131 | 1/1940 | Lippold | 51/139 |
| 2,714,278 | 8/1955 | Dostert | 51/140 |
| 2,936,551 | 5/1960 | Rich et al. | 51/140 |
| 3,169,352 | 2/1965 | Smith | 51/140 |
| 3,608,245 | 9/1971 | Fair, Jr. et al. | 51/140 |
| 3,663,319 | 1/1972 | Maag | 51/140 |
| 4,322,918 | 4/1982 | Steinbeck | 51/358 |
| 4,733,500 | 3/1988 | David | 51/138 |

FOREIGN PATENT DOCUMENTS

| | | | |
|---|---|---|---|
| 504355 | 7/1930 | Fed. Rep. of Germany | 51/140 |

*Primary Examiner*—M. Rachuba
*Attorney, Agent, or Firm*—Bacon & Thomas

[57] ABSTRACT

A sanding mechanism for a belt sander comprises a first set of sanding heads for sanding the upper surface of a workpiece passing therethrough, and a second set of sanding heads for sanding the bottom surface of the workpiece. The first and second sets of sanding heads each comprises a front sanding head disposed in a direction 30° to 60° relative to the workpiece feeding direction for primary sanding operation and a rear sanding head disposed in parallel with the workpiece feeding direction for a fine finish sanding operation. Each front sanding head including two rows of guide wheels bilaterally disposed at the bottom thereof for guiding the workpiece to move in the workpiece feeding direction.

2 Claims, 4 Drawing Sheets

BELT SANDER SANDING MECHANISM

BACKGROUND OF THE INVENTION

The present invention relates to belt sanders and relates more particularly to an improved sanding mechanism for a belt sander which can effectively sand a workpiece through two different angular directions and eliminate grinding burn problems.

In wood-working, belt sanders have been commonly used for sanding the surface of a wooden board so as to make it smooth. In regular belt sanders, the sanding mechanism, as shown in FIG. 1, is generally comprised of two sanding heads, namely, a front sanding head for primary sanding and a rear sanding head for fine finish sanding. In this sanding mechanism, the sanding direction of the front and rear sanding heads is parallel with the feeding direction of the workpiece to be polished. Because the sanding belt of the front sanding head and the sanding belt of the rear sanding head are rotated in the same direction, a fine finish is difficult to achieve and grinding burn problems tend to happen. Further, because there is only one set of sanding heads (the front and rear sanding heads) installed above the conveyer, a workpiece shall be processed twice so that the two opposite sides thereof can be completely polished. Therefore, this sanding mechanism is not efficient in use.

The present invention has been accomplished to eliminate the aforesaid disadvantages and problems. It is therefore an object of the present invention to provide a sanding mechanism for a belt sander which is easy to operate and can eliminate grinding burn problems. It is still another object of the present invention to provide a sanding mechanism for a belt sander which can simultaneously sand the two opposite surfaces of a workpiece at the same time. According to the present invention, two sets of sanding heads are provided for sanding the upper and bottom surfaces of a workpiece at the same time. Each set of sanding heads includes a front sanding head disposed at a 30° to 60° angle relative to workpiece feeding direction for primary sanding operation and a rear sanding head disposed in parallel with the workpiece feeding direction for fine finish sanding operation. Guide wheels are fastened in the front sanding head for guiding a workpiece in the workpiece feeding direction for positive sanding operation.

DETAILED DESCRIPTION OF THE PREFERRED EMBODIMENT

Figure 1:
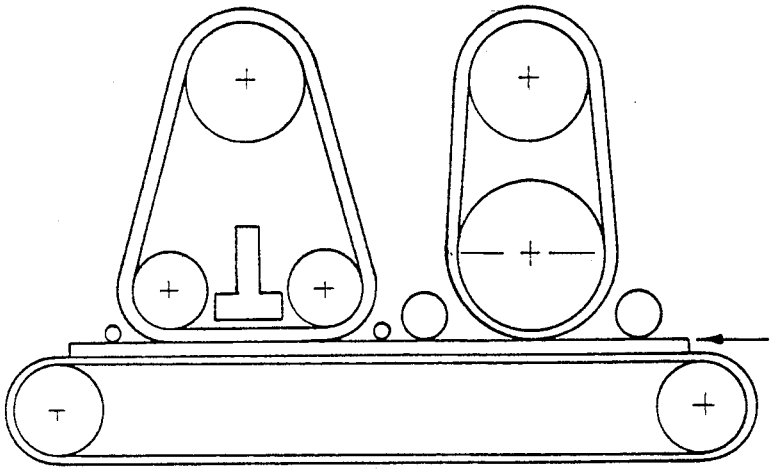
Fig. 1 PRIOR ART
FIG. 1 illustrates a sanding mechanism for a belt sander according to the prior art.
Figure 2:
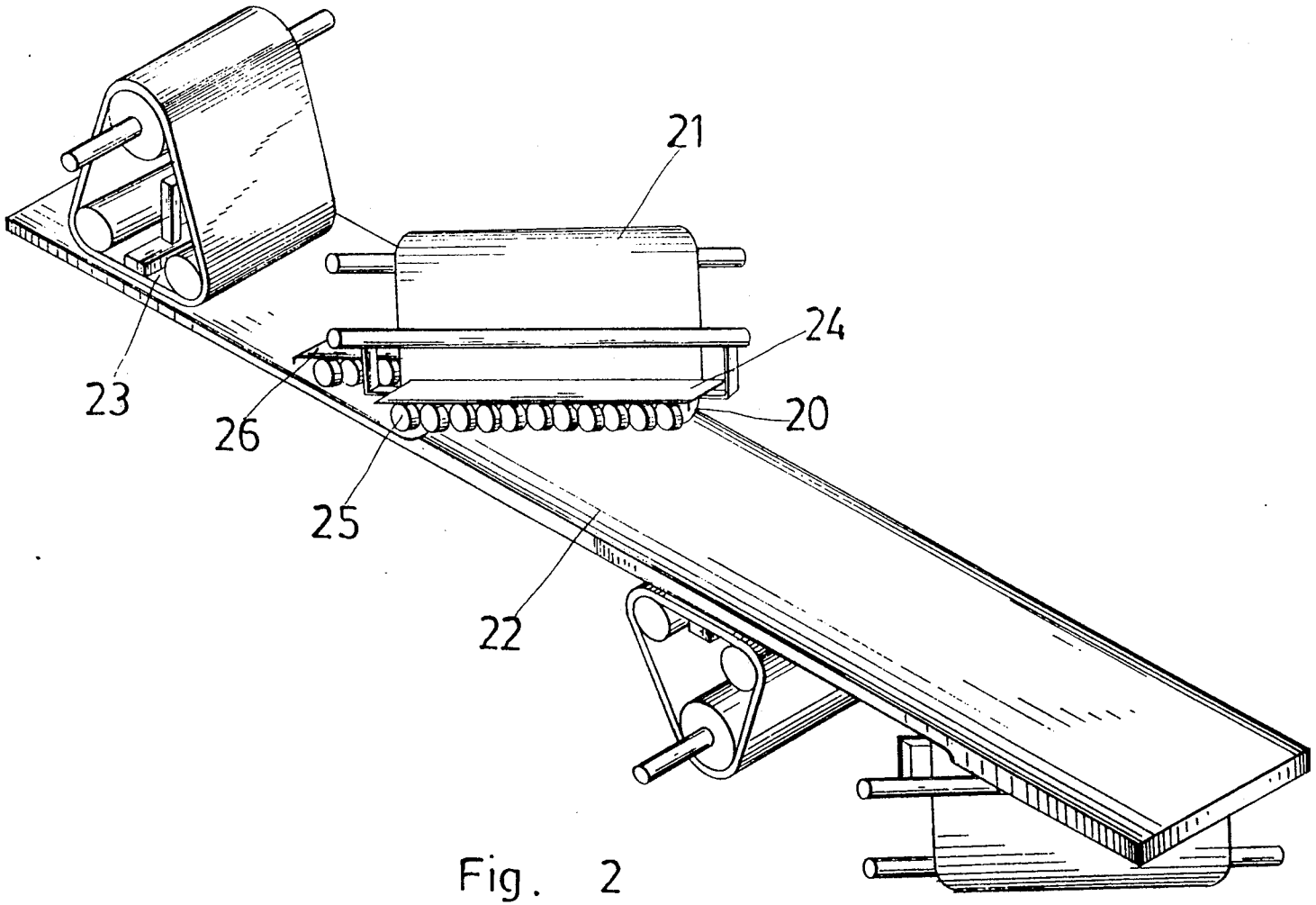
FIG. 2 is an elevational view of the preferred embodiment of the sanding mechanism of the present invention.
Figure 3:
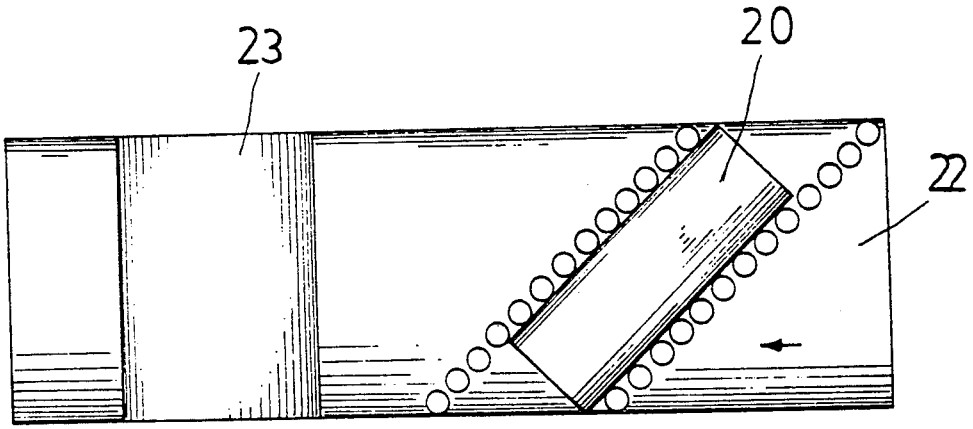
FIG. 3 is a top view of the preferred embodiment of the sanding mechanism of the present invention.
Figure 4:
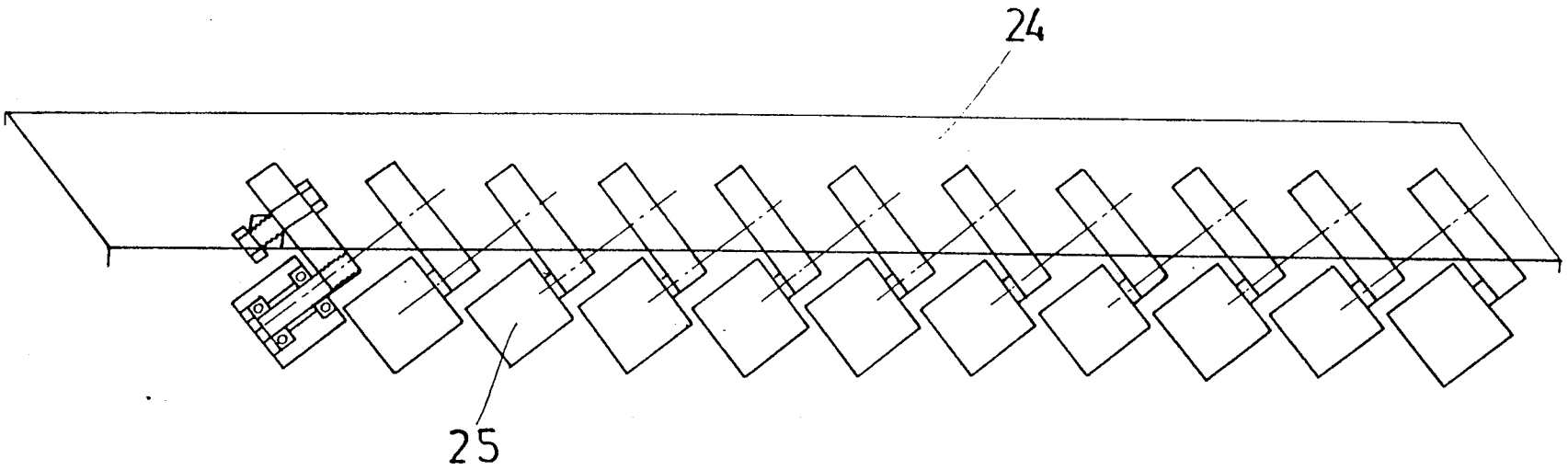
FIG. 4 illustrates the arrangement of the guide rollers on the supporting frame.

Referring to FIGS. 2, 3 and 4, a sanding mechanism for a belt sander as constructed in accordance with the present invention is generally comprised of two sets of sanding heads, each of which including a front sanding head 20 for primary sanding and a rear sanding head 23 for fine finish sanding. The front and rear sanding heads of the first set are spaced from each other and disposed at an upper level at one end for sanding the upper surface of a workpiece 22 while the front and rear sanding heads of the second set are spaced from each other and disposed an a lower level at an opposite end for sanding the bottom surface of workpiece 22. Therefore, two opposite faces of a workpiece can be simultaneously polished through a single processing procedure.

Referring to FIGS. 2 and 3 again, the front sanding head 20 is disposed in an angular position within 30° to 60° angle relative to the rear sanding head 23 which is disposed in parallel with the moving direction of the workpiece 22 to be polished. Therefore, the sanding belt 21 on the front sanding head 20 is rotated to sand the workpiece 22 which passes therethrough at an angle within 30° to 60° relative to the moving direction of the workpiece 22 while the rear sanding head 23 is rotated to sand the workpiece 22 in the same direction as the moving direction of the workpiece 22. Because the front sanding head 20 is disposed at a 30° to 60° angle relative to the moving direction of the workpiece to be polished, higher downward pressure is applied to the workpiece which passes therethrough, and therefore, a better sanding effect can be achieve. Since the rear sanding head 23 is provided for fine finish sanding, less pressure is required to be applied to the workpiece to be polished. Further, the front sanding head 20 has two substantially U-shaped frames 24, 26 bilaterally fastened thereto at the bottom in an inverted position for holding two rows of guide rollers 25, see also FIG. 4, which guide the workpiece 22 to be polished to move in a predetermined feeding direction for positive sanding.

The front sanding head 20 and the frames 24, 26 thereof and the rear sanding head 23 of each set of sanding heads are fastened in the machine frame of the belt sander by fastening rods. Further, there is provided adjusting means for adjusting the level position of each set of sanding heads to achieve a positive sanding operation. However, this adjusting means is not described herein since it is not within the scope of the present invention.

I claim:

1. A sanding mechanism for simultaneously sanding opposing faces of a workpiece comprising:

a first set of endless belt-type sanding units adapted to sand one face of a longitudinally fed workpiece, said first set of endless belt-type sanding units including a primary sanding unit disposed at an angle of 30° to 60° relative to a workpiece feeding direction and a finishing sanding unit, located downstream of said primary sanding unit in the workpiece feeding direction, arranged in parallel with the workpiece feeding direction;

a second set of endless belt-type sanding units adapted to sand an opposing face of the longitudinally fed workpiece, said second set of endless belt-type sanding units including a primary sanding unit disposed at an angle of 30° to 60° relative to the workpiece feeding direction and a finishing sanding unit, located downstream of said primary sanding unit of said second set of endless belt-type sanding units in the workpiece feeding direction, arranged in parallel with the workpiece feeding direction, said second set of endless belt-type sanding units being located upstream of said first set of endless belt-type sanding units in the workpiece feeding direction;

first and second spaced supporting frames secured to each of said primary sanding units of said first and second sets of endless belt-type sanding units; and a plurality of guide rollers carried by each of said supporting frames for guiding a workpiece between said first and second sets of endless belt-type sanding units in the workpiece feeding direction.

2. A sanding mechanism as claimed in claim 1, wherein each of said supporting frames is generally U-shaped.

* * * * *